US008323757B2

(12) United States Patent
Barto

(10) Patent No.: US 8,323,757 B2
(45) Date of Patent: Dec. 4, 2012

(54) ARTIFICIAL CHRISTMAS TREE AND ANTLER APPARATUS

(76) Inventor: Benjamin Charles Barto, Dubois, WY (US)

( * ) Notice: Subject to any disclaimer, the term of this patent is extended or adjusted under 35 U.S.C. 154(b) by 0 days.

(21) Appl. No.: 13/337,096

(22) Filed: Dec. 24, 2011

(65) Prior Publication Data

US 2012/0171394 A1 Jul. 5, 2012

Related U.S. Application Data

(60) Provisional application No. 61/428,060, filed on Dec. 29, 2010.

(51) Int. Cl.
*A47G 33/06* (2006.01)

(52) U.S. Cl. ..... 428/19; 428/18; 428/20

(58) Field of Classification Search ..... 428/18, 428/19, 20

See application file for complete search history.

(56) References Cited

U.S. PATENT DOCUMENTS

| | | | | |
|---|---|---|---|---|
| 2,951,303 | A | 9/1960 | Hovlid | |
| 2,992,503 | A * | 7/1961 | Webb | 43/1 |
| 4,156,892 | A * | 5/1979 | Fisher | 362/123 |
| 6,180,194 | B1 | 1/2001 | Liang | |
| 6,306,471 | B1 * | 10/2001 | Pitman et al. | 428/18 |
| D521,178 | S * | 5/2006 | Sheng | D26/92 |
| 2012/0056060 | A1 * | 3/2012 | Parton | 248/304 |

* cited by examiner

*Primary Examiner* — Aaron Austin
(74) *Attorney, Agent, or Firm* — Daniel Boudwin; Alex Boyer; Amber Stiles

(57) ABSTRACT

An artificial Christmas tree with an array of imitation animal antlers incorporated into the tree to serve as additional branches. The purpose of the incorporated animal antler branches is to provide structural support to the tree so that the device can hold a multitude of Christmas ornaments. The antlers serve as strong branches and can support the weight of several heavy Christmas ornaments at once on each animal antler branch, while providing an ornamental and novel looking tree device for supporting hanging articles and Christmas decoration. Each antler has plurality of elongated prongs, allowing a user to place many ornaments on a single antler without resulting in deflection thereof. The antlers strength keeps the branches from drooping under the weight of the decorations, which leaves the Christmas tree aesthetically pleasing to the eye and particularly attractive for animal hunters and enthusiasts.

7 Claims, 3 Drawing Sheets

ARTIFICIAL CHRISTMAS TREE AND ANTLER APPARATUS

CROSS REFERENCE TO RELATED APPLICATION

This application claims the benefit of U.S. Provisional Application No. 61/428,060 filed on Dec. 29, 2010, entitled "Buckhorn Pine Christmas Tree."

BACKGROUND OF THE INVENTION

1. Field of the Invention

The present invention relates to artificial Christmas trees for the purpose of holding a plurality of decorative ornaments. More specifically, the present invention incorporates the use of animal antlers or imitation versions thereof as branches of the tree to give the tree additional support when holding a multitude of decorative Christmas ornaments.

2. Description of the Prior Art

Tree decorating is a tradition that has long been practiced by many individuals who celebrate the holiday of Christmas. Christmas is a revered time of year because of activities such as these. Some individuals choose to use a real tree for their holiday festivities, while others prefer the ease and reusability of artificial tree devices. One desirable feature of having a real tree for the holidays is that a real tree gives a home a piney holiday scent. Unfortunately, a real tree can also be messy and many individuals do not enjoy or appreciate the inconvenient consequences of using a real Christmas tree indoors over a prolonged period. There are many problems associated with real trees; e.g., maintaining the tree during the holiday season, cleaning up pine needles that have fallen off the tree and on the floor and the possibility that sap from the tree may be tracked onto furniture or the floor. Further still, the load carrying capacity of real trees limbs may be inadequate for larger ornaments or a large number thereof.

Artificial trees provide a convenient solution to many of these common problems. The options available when it comes to selecting an artificial tree are immense. Some are designed to imitate real trees, equipped with artificial branches and needles, while others do not represent any natural features of a tree in the flora sense of the word. Most artificial trees employ similar design elements for the purpose of providing a deconstructable tree structure with fake limbs, branches and a main tree trunk. Some provide built-in lights, candle holders and some are designed to hold ornaments, cards or holiday candy using a specific receptacle. The present invention is designed to provide a novelty outdoorsman Christmas tree that is adapted to hold a plurality of ornaments using both artificial tree limbs and imbedded animal antlers. The present tree provides both utility in the form of larger load capacity for larger ornaments, while providing hunters, outdoorsman and enthusiasts with a uniquely structured tree device.

Patents have been granted for many Christmas tree devices or for those that provide an artificial alternative to a real tree that has been cut and decorated. Some of the prior art patents describe devices that are designed to hold ornaments, while others provided imbedded features that are inherently ornamental or illuminating. These prior art devices have several known drawbacks. For example, they are limited in their ability to provide additional support for heavier ornaments and a plurality thereof, and further do not provide novelty design aspects that are particularly suited for outdoorsman and animal hunting enthusiasts.

U.S. Pat. No. 6,180,194 to Liang describes a device designed to resemble a Christmas tree. The device consists of a central shaft securely attached to a base. The central shaft serves as the tree trunk of the device. Loops of wire, which are oval in shape, serve as the device's tree branches. Smaller loop branches are located closer to the top of the central shaft tree trunk and the loops get gradually larger closer to the bottom of the device, resulting in an overall cone-shaped tree. Each wire loop branch is physically attached to the central shaft tree trunk.

The Liang device's tree branches are comprised of two wires; the first is the previously describe wire loop, which gives the branch its overall oval shape, and a second wire coiled around the first wire loop. The coiled wire wraps around the wire loop branch to create a multitude of small protrusions from the wire loop. The coiled wire is secured to the wire loop so that the coils extend outward further from the center of the loop branch than the wire loop. The purpose of the coils is to simulate the leaves, or pine needles, of a Christmas tree. The construction of the Liang device's tree branches facilitates the hanging of ornaments from either the wire loop branches or the coiled wire leaves. It is recommended that heavier ornaments be hung from the wire loop branches of the device, while lighter ornaments can be hung from the coiled wire leaves.

The Liang device requires a user to carefully monitor where he or she hangs a specific Christmas ornament based on the weight of the ornament, suggesting that the tree is not designed to accommodate a multitude of decorative ornaments, especially a multitude of heavy ornaments on a single branch. The present invention is designed for hanging a plurality of Christmas ornaments, wherever a user chooses, on the incorporated imitation animal antlers branches. The antlers are specifically designed to hold multiple heavy ornaments per antler and will maintain structural integrity under the weight of the ornaments.

U.S. Pat. No. 2,951,303 to Hovlid describes a Christmas card holder device that is designed to resemble a Christmas tree when Christmas cards are attached to the device. When a user receives Christmas cards in the mail or from visiting friends and family, the cards can be displayed all season long in a festive and decorative way. The display tree device consists of a central metal shaft for supporting a wire spiral attached to at the top of the shaft, which wraps downward around the center shaft, with the radius of the spiral getting wider as the spiral gets closer to the ground, resulting in a cone-shaped structure similar to the shape of a Christmas tree. A plurality of small clips attach to the metal spiral of the device for clipping the Christmas cards to the display device. A second embodiment of the Hovlid device describes the same device, but instead of holding Christmas cards, the clips are used to hold Christmas ornaments so that the Christmas ornaments can be displayed on the tree device in a decorative way.

The present invention provides a new and improved artificial Christmas tree having unique ornament support elements and features resembling animal antlers attached to the trunk of the tree as would a normal tree branch. In this way, artificial tree branches and antlers extend from the trunk and provide a means to support ornaments thereon. The overall look of the tree is one that is uniquely appealing to outdoorsman and hunters, and is one that can be quickly and easily assembled using no special tools. The elements of the present invention substantially diverges in design from the prior art, and consequently it is clear that there is a need in the art for an improvement to existing artificial Christmas tree devices. In this regard the instant invention substantially fulfills these needs.

SUMMARY OF THE INVENTION

In view of the foregoing disadvantages inherent in the known types of artificial Christmas trees now present in the prior art, the present invention provides a new type of artificial Christmas tree that is unique and designed to hold a plurality of large ornaments and provide an unique twist on a traditional artificial tree.

It is therefore an object of the present invention to provide a new and improved artificial Christmas tree device that has all of the advantages of the prior art and none of the disadvantages.

Another object of the present invention is to incorporate imitation animal antlers in place of branches on the tree to provide structure for the weight associated with holding a plurality of heavy Christmas ornaments at once.

Yet another object of the present invention is to provide users with a unique holiday decorating experience through the use of imitation and real animal antlers.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
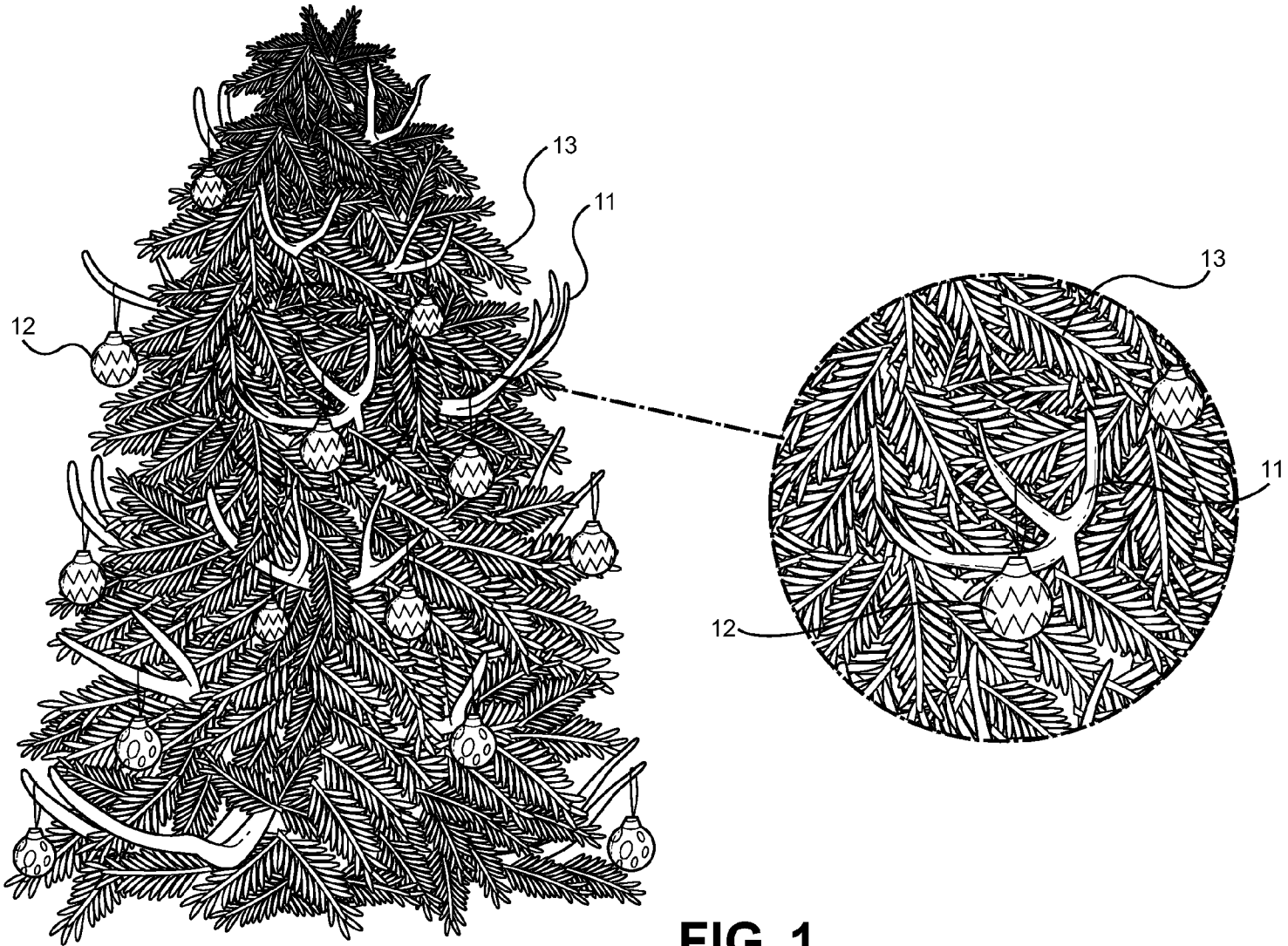
FIG. 1 is a view of the present invention in a working position, decorated for Christmas and adorned with several ornaments.

Reference is made herein to the attached drawings. Like reference numerals are used throughout the drawings to depict like or similar elements of the Christmas tree device. For the purposes of presenting a brief and clear description of the present invention, the preferred embodiment will be discussed as used for providing a novel tree having removably attached tree branches and animal antlers. The figures are intended for representative purposes only and should not be considered to be limiting in any respect.

Referring now to FIG. 1, there is shown a view of the antler tree device of the present invention in an assembled and working position. The tree comprises a central trunk or main support along which are supplied a plurality of limb and antler attachment collars. The base of the central trunk is supported by a base structure that holds the trunk in an upstanding position and provides a means to adjust the orientation of the trunk to ensure a vertically aligned tree when assembled. Antler branches 11 of the tree extend from the trunk collars in an outward configuration, and are adapted to be sparsely situated among a plurality of simulated tree branches 13 which form the limbs and needles of the artificial tree. The collars are spread along the length of the trunk and create rows of supported limbs and antlers, which when fully assembled are not visible from the exterior of the tree, and the tree appears as a continuously, full-bodied tree with continuous limbs extending from the trunk.

A user decorates the Christmas tree device by placing ornaments 12 on the branches 13 and antlers 11 of the tree device. The antlers 11 provide a rigid support for larger ornaments 12, which may otherwise weigh down the less rigid branches 13, causing them to droop or sag. FIG. 1 also depicts a magnified view of the present invention, highlighting an imitation antler 11 holding a decorative Christmas ornament 12. The imitation animal antlers can be made from an assortment of materials, including but not limited to, resin, plastic or rubber. The antlers may vary in length, size and shape, and may incorporate a plurality of prongs in order to simulate a random assortment of animal antlers. In addition to the artificial tree branches of the present invention, imitation animal antler branches will be incorporated into the tree and serve as additional branches of the tree for hanging decorative Christmas ornaments upon. The antlers also serve a novelty and decorative appearance that is appreciated by outdoorsman and hunters. Each imitation animal antler branch 11 has a decorative distal end and a proximal attachment end for connecting the antler branch to the center shaft tree trunk collar of the device during the assembly process to form a Christmas tree device.

Figure 2:
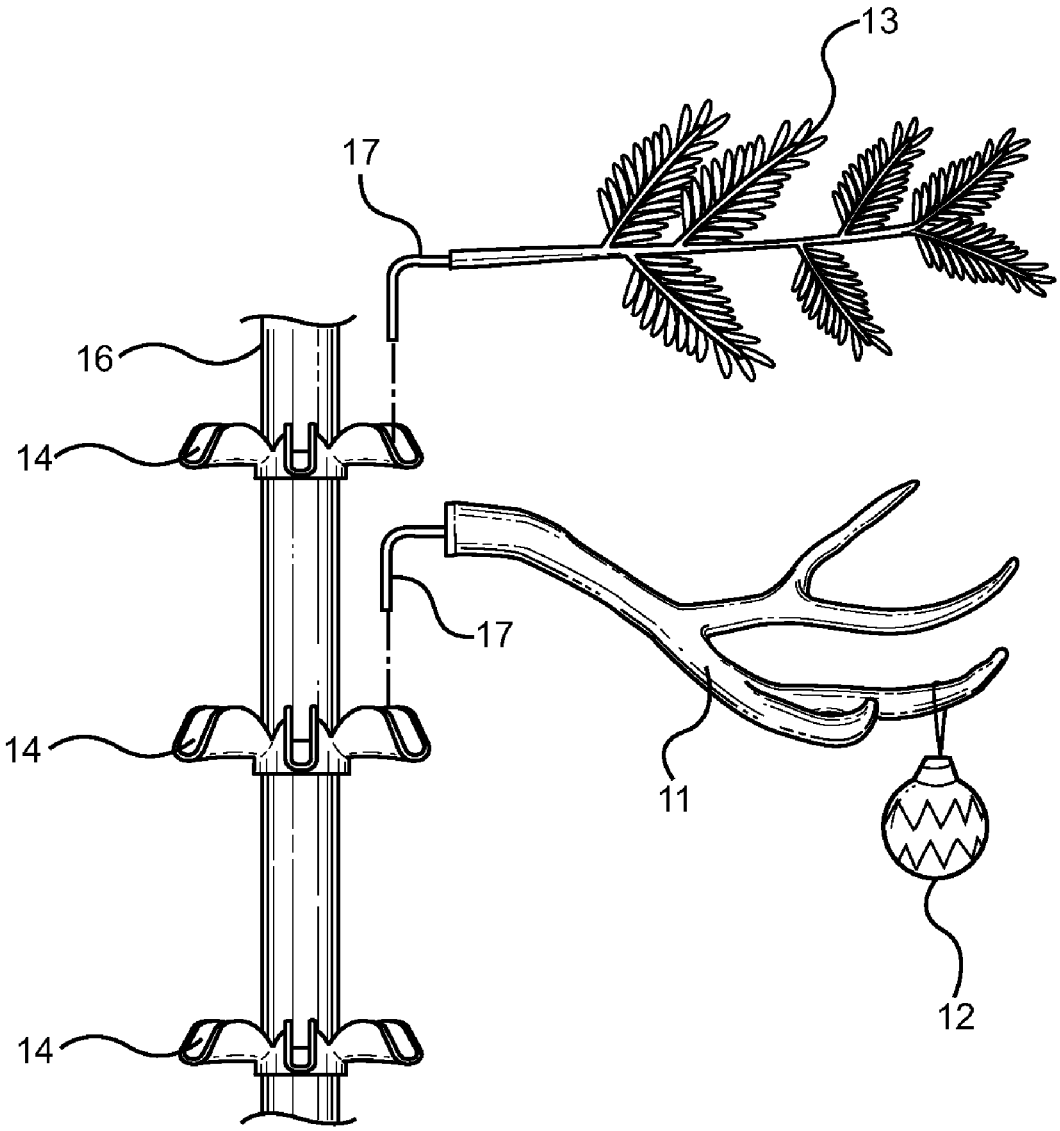
FIG. 2 is a side view of the attachment of the present invention artificial tree branches and the animal antler branches to the trunk of the tree via branch receiving collars.

Referring now to FIG. 2, there is shown a perspective view of the branch and antler engagement with the central trunk collars 14 during assembly. The present invention comprises a central shaft 16 that serves as the tree's trunk and central support for allowing each branch 13 and antler 11 to be attached thereto. The center shaft tree trunk 16 is a cylindrical shaft that is constructed of any durable, rigid material capable of being disassembled into smaller, more manageable sections for storage purposes. The central trunk can be utilized to attached connection rods from each branch 13 or antler directly via a plurality of apertures, or preferably a plurality of attachment collars 14 located around the central shaft 16 at regular intervals, serving as holders for the each branch type, either the tree limb 13 or the antler 11. This allows the tree to be constructed in a desired fashion, wherein the order and position of antlers and limbs can be controlled by the user according to his or her desires. In an exemplary embodiment of the present invention, the collars are comprised of circular rings with U-shaped projections extending radially therefrom and having pronged attachment apertures thereon for engagement with either the limb or antler prongs.

Each of the artificial tree branches 13 and the imitation animal antler branches 11 has a decorative end and an attachment end for attaching to the tree trunk collars 14. One embodiment of the present invention has the attachment end having a pronged engagement with a small ninety degree bend designed to be attached to the tree trunk collars by inserting the bended attachment ends of the branches into holes locatable on the U-shaped receiving brackets of the tree trunk collars.

Figure 3:
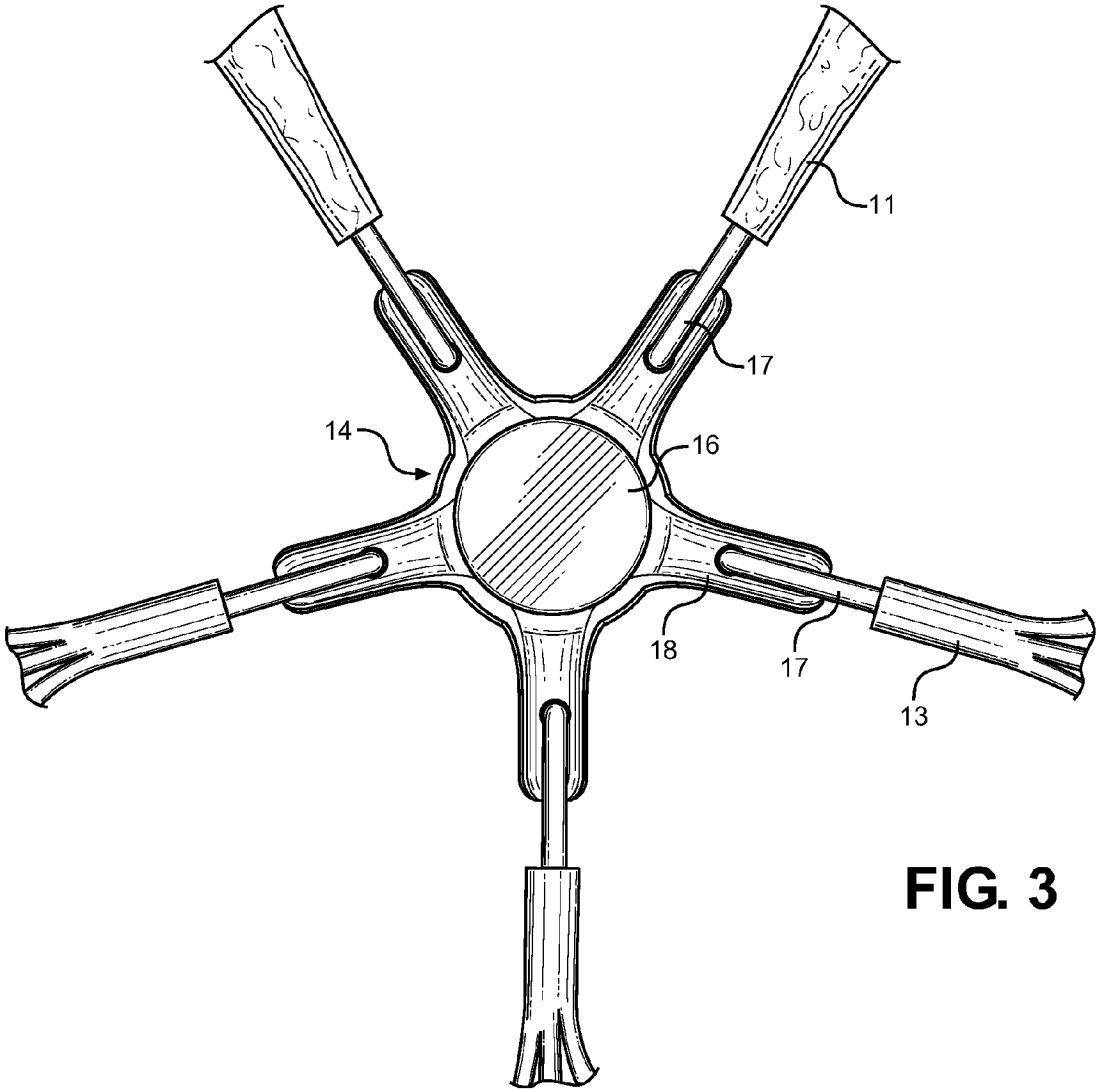
FIG. 3 is an overhead view of the branch receiving collars in connection with a plurality of branches and antlers.

Referring now to FIG. 3, there is shown an overhead view of the artificial tree of the present invention highlighting the connection of the branches 13 and antlers 11 to the central shaft 16. As shown, a trunk collar 14 is positioned around the circumference of the central shaft 16. The collar 14 is preferably positioned along the length of the trunk 16 in a regularly spaced interval and connected to the trunk 16 using a set screw or similar engagement that maintains a static position of the collar with respect to the trunk and prevents dislodgement or sliding thereof once installed. The collars employ a circular opening that accepts the trunk therethrough, while a plurality of branch connecting projections 18 extend radially from the trunk. The projections 18 each have an aperture adapted to be engaged by an antler or branch connecting prong, while the U-shape of each projection supports the prong after being inserted into the aperture. In this way, the collars support a plurality of branches and antlers in a static position and located along the length of the trunk and extending thereaway from. The number of collars 14, their spacing, the number of projections 18 and the location of branches 13 and antlers 11 therealong is configurable by the user as the tree is constructed. The trunk is assembled from a plurality of smaller lengths, whereafter the limbs and antlers are attached, in a similar fashion as traditional artificial tree devices.

In use, an individual would first assemble the device's tree trunk and base. The user attaches together the trunk pieces and then attaches the trunk into the base support. The branch and antler attachment collars are either installed along the trunk or already in place, attached to the tree trunk from the manufacturer, such that the user need not be concerned with how to attach the collars. Alternatively, a plurality of prong-accepting apertures along the length of the trunk may replace the collars. A user inserts the artificial tree branches and the antler branches into the collars, while being mindful to place shorter branches and antlers towards the top of the tree trunk, and longer branches closer to the bottom of the tree if the user desires to achieve an overall tapering tree shape that resembles a pine tree or Christmas tree likeness. Another embodiment of the present invention features branches of all the same length such that the fully assembled tree employs a cylindrical shape. A further embodiment contemplates lighting within the branches, allowing the branches to illuminate and power to distribute through the trunk and into each branch for illumination and decoration purposes.

Overall, the present device serves as a novel, decorative tree assembly that supports a plurality of ornaments thereon. The antlers are particularly suited for heavier ornaments, while the construction of the tree is adapted for swift setup and deconstruction when stowage is desired. The overall look of the tree is one that may be enjoyed by outdoorsman, hunters and enthusiasts alike, while providing novel twist to a traditional artificial tree device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An artificial tree device, comprising:

an upstanding central support shaft, said shaft being connected to a base support;

a plurality of artificial tree branches;

a plurality of animal antler branches;

said branches having a decorative end and a connector end, said connector end a plurality of receiving collars positionable along the length of said central support, each of said receiving collars having a central cut-out sized to encircle said central support, and having a plurality of connection points extending radially outward for engaging with said connector ends of said branches.

2. The device of claim 1, wherein said central support shaft is separable into smaller segments that can be attached together during assembly of said device.

3. The device of claim 1, wherein said branch connector end comprises a prong device removably engageable with any of said connection points of said receiving collars.

4. The device of claim 1, wherein said animal antler branches are imitation antlers.

5. The device of claim 1, further comprising:

a plurality of apertures disposed along said central support and removably engageable with said branch connector ends.

6. The device of claim 1, wherein said tree branches further comprise imbedded electrical illumination means for decoration purposes.

7. The device of claim 1, wherein said animal antler branches further comprise imbedded electrical illumination means for decoration purposes.

* * * * *